United States Patent [19]

Green

[11] Patent Number: 4,675,570

[45] Date of Patent: Jun. 23, 1987

[54] TUNGSTEN-IRIDIUM IMPREGNATED CATHODE

[75] Inventor: Michael C. Green, Palo Alto, Calif.

[73] Assignee: Varian Associates, Inc., Palo Alto, Calif.

[21] Appl. No.: 851,896

[22] Filed: Apr. 11, 1986

Related U.S. Application Data

[63] Continuation of Ser. No. 595,789, Apr. 2, 1984, abandoned.

[51] Int. Cl.[4] ..... H01J 1/14; H01J 19/06

[52] U.S. Cl. ..... 313/346 R; 313/346 DC; 252/514; 252/515; 445/51

[58] Field of Search ..... 313/346 R, 346 DC, 341; 252/514, 515; 445/51

[56] References Cited

U.S. PATENT DOCUMENTS

| | | | |
|---|---|---|---|
| 2,700,000 | 1/1955 | Levi | 313/346 R |
| 3,373,307 | 3/1968 | Zalm et al. | 313/346 DC |
| 4,165,473 | 8/1979 | Falce | 313/346 R |
| 4,417,173 | 11/1983 | Tuck et al. | 313/346 DC |
| 4,518,890 | 5/1985 | Taguchi et al. | 313/346 R |

*Primary Examiner*—David K. Moore
*Assistant Examiner*—K. Wieder
*Attorney, Agent, or Firm*—Stanley Z. Cole; Gerald M. Fisher; Kenneth L. Warsh

[57] ABSTRACT

Porous agglomerates are made from pure tungsten by sintering fine particles together and mechanically breaking down the mass to form some agglomerates considerably larger than the particles. These agglomerates are mixed with fine iridium powder and sintered to form a porous mass. The mass is machined to the cathode shapes and impregnated with an alkaline earth aluminate. The large agglomerates alloy with the iridium only on their outer surface. Their pure tungsten interior provides the surfaces to reduce the alkaline earth oxide to the metal which activates the cathode.

15 Claims, 2 Drawing Figures

FIG. 1
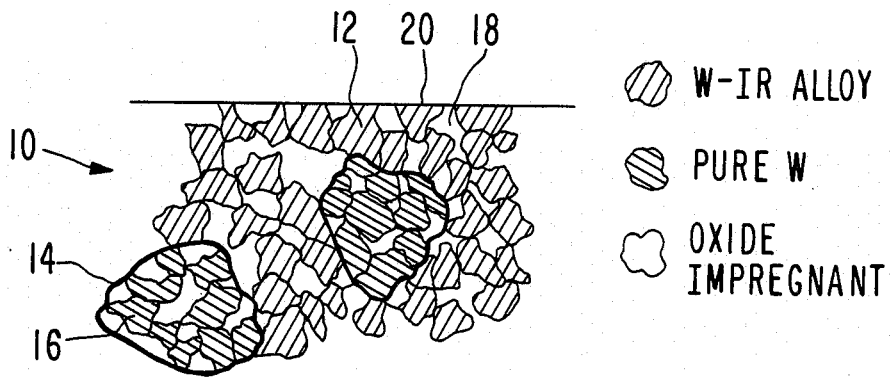
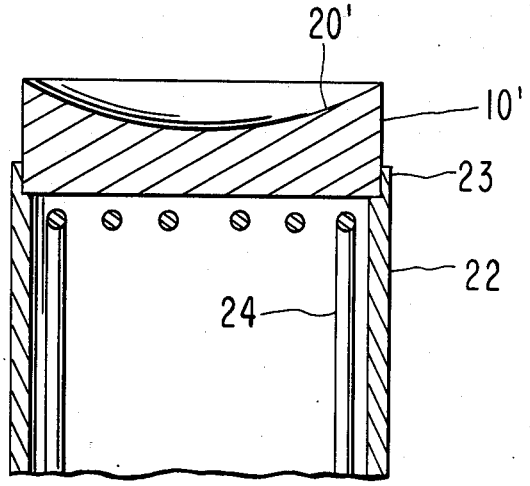
FIG. 2

TUNGSTEN-IRIDIUM IMPREGNATED CATHODE

This invention was made with Government support under Contact No. DAAK20-81-C-0421 awarded by the Department of Defense. The Government has certain rights in this invention.

This application is a continuation of application Ser. No. 595,789, filed Apr. 2, 1984, now abandoned.

FIELD OF THE INVENTION

The invention pertains to thermionic cathodes in which a porous body of refractory metal is impregnated with a molten oxide containing an alkali-earth.

PRIOR ART

Early impregnated cathodes were made by sintering a body of powdered tungsten to form a porous block. The porous material was impregnated with molten copper or an organic polymer to make it machinable to its desired shape. After machining this impregnant was removed and the porous cathode was impregnated with a molten barium aluminate. U.S. Pat. No. 2,700,000 issued Jan. 18, 1955 to R. Levi such a cathode.

U.S. Pat. No. 3,373,307 issued Nov. 12, 1964 describes an improved impregnated cathode in which the emissive surface is coated with iridium or other metals of its group. The coating improves the electron emission, but it has been found that the improvement is often short-lived. A principal problem seems to be that, in an electron tube where high current density is drawn from the cathode at high voltage, ions are formed from the residual gas. They are accelerated back to the cathode and sputter away a thin layer from its surface, removing the iridium.

U.S. Pat. No. 4,165,473 issued Aug. 21, 1979 to Louis R. Falce and assigned to the assignee of the present invention, discloses a cathode in which particles of iridium or the like are dispersed among the tungsten particles of the matrix. During sintering the iridium partially alloys with the tungsten. This dispersed cathode solved the problem of surface sputtering. It has been found, however, that the sintering is a very delicate process. If the time and temperature are enough to get a lot of alloying, the emission is often poor. If the sintering is held to a minimum, the emission is initially good, but interdiffusion of iridium and tungsten occurs at operating temperature to form unreactive alloy. This in turn causes the barium supply to the surface to fall off with a resultant decay in emission. Also, shrinkage of the cathode button can take place with the distortion of the emitting surface, which impacts adversely on the electron optics of the gun.

PURPOSE OF THE INVENTION

An object of the invention is to provide a cathode with improved emission over a long life span.

Another object is to provide a cathode which is tolerant of the exact parameters of manufacture and operation.

These objects are realized by forming the porous matrix of a mix of two kinds of grains: small particles of tungsten-iridium alloy, and large grains composed of a porous matrix of pure tungsten.

BRIEF DESCRIPTION OF THE DRAWINGS

FIG. 1 is a schematic enlarged cross-section of a portion of a cathode embodying the invention.

FIG. 2 is a cross-section of a concave cathode for a linear-beam microwave tube.

DESCRIPTION OF THE PREFERRED EMBODIMENTS

As a basis for the physical form of my inventive cathode, following is a brief description of my concept of the operation of a dispenser cathode. Basically there are two requirements which in prior-art cathodes were often at odds.

First, an emitting surface is required which has a low work-function. This is provided by a thin (sometimes monatomic) layer of an alkaline earth metal such as barium, strontium, calcium or mixtures thereof and often containing oxygen as well.

The second requirement is a means for replenishing the active layer as it is removed in operation by evaporation or sputtering.

In the following description I use the word "tungsten" to include a number of refractory, moderately chemically active metals such as molybdenum. I use the word "barium" as an example of an alkaline earth metal or compound, which may additionally include calcium, strontium, and alloys thereof as well.

In the original tungsten matrix cathodes the emitting layer is on the surface of the porous tungsten. It has a moderately low work function and thus gives emission capability of a few amperes per square centimeter. The life is very good however, because the surfaces of the tungsten matrix in contact with the barium aluminate impregnant are chemically reducing at the operating temperature of around 1000° C., sufficient to react with the oxide and produce free barium atoms. This barium can then be transported to the active surface to re-activate it as fast as surface material was removed.

The addition of a surface layer of iridium or other metals of the platinum group produces a significant further lowering of the work function and hence higher emission density. The work function is believed to be affected by the extent to which the surface metal can polarize the barium dipole layer. The iridium provides tighter bonding of the barium atoms, reducing evaporation as well as work function. Iridium, however, has low reducing power. When it is added to the matrix as taught by U.S. Pat. No. 4,165,473 it alloys with the tungsten, perhaps more as a surface coating than a bulk alloy. This will decrease the reducing power of the tungsten and slow the replenishment of lost barium.

In carrying out my invention as shown in FIG. 1, I provide relatively large, porous "islands" of pure tungsten in a matrix 10 of tungsten-iridium alloy particles 12. The iridium provides a surface 20 which can be activated to have a low work function. Even when surface material is removed, the surface is regenerated. The pure tungsten islands 14 are porous grains, each formed from many fine tungsten particles 16 sintered together. Their large surface area provides a reducing interface with the impregnant 18 to produce an adequate supply of reactivating barium to the emitting surface 20. The size and convolutions of the tungsten islands 14 are sufficient to prevent alloying with the iridium except on their outer surfaces.

As an example of the process for producing the inventive cathode, the following steps are performed:

1. Porous tungsten bar stock is made by compressing and sintering fine tungsten powder particles of about 5 microns diameter, as is well known in the art. The density of the resulting bar is about 72%, of that of solid tungsten.

2. The bar is impregnated with a liquid plastic monomer such as methyl methacrylate which is then polymerized by heat as described in U.S. Pat. No. 3,076,916 issued Feb. 5, 1963 to Otto G. Koppius. The bar is broken down into a mixture of agglomerates by machining, such as turning on a lathe.

3. The plastic infiltrant is removed from the agglomerates and any carbon residues are cleaned up by firing in wet hydrogen at 750° C.

4. Agglomerates larger than 150 microns are sieved out and discarded.

5. The tungsten agglomerates and fines which pass through a 100 mesh sieve are tumble mixed with −325 mesh iridium powder in the proportion of 60 parts by weight of tungsten to 40 parts of iridium.

6. The powder mix is pressed at 50,000 psi and the resultant compact sintered in hydrogen at 1720° C. to give pure tungsten agglomerates dispersed n a matrix of iridium-tungsten alloy. Most of the agglomerates are large compared to the iridium particles. The tungsten fines alloy with the iridium particles.

7. The sintered body is then manufactured into cathode elements by conventional techniques:

7a. Molten copper is infiltrated into the pores to provide support for machining. 7b. The cathode shapes are machined from the copper-infiltrated bar. 7c. The copper is removed by chemical etching and hydrogen firing. 7d. The cathode elements are impregnated in hydrogen or vacuum with barium-calcium aluminate, typically $6BaO:1CaO:2Al_2O_3$.

8. The emissive surface may be sputter coated with a codeposited 50:50 mixture of tungsten and iridium. This is nearly the same composition as the iridium-tungsten alloy mixture, so its removal by ion sputtering does not seriously affect the cathode.

This embodiment of the invention has been found to provide emission current densities equal or superior to, and lives exceeding those of, the best examples of the prior art. However, unlike the prior art, this cathode can be reproducibly manufactured. Cathodes capable of 8 amperes per square centimeter below 1050° C. brightness have been produced with greater than 90% yield. Running temperatures for a given current density were within 10° C. of each other. The performance was very stable with operating time. Cathodes have passed 4,000 hours at 8 $A/cm^2$ with practically no change.

The large agglomerates alloy with the iridium during sintering and subsequent operation, but due to their size the alloying occurs only at their outer surfaces. They are porous and are completely infiltrated by the active oxide so that the reduction to produce barium goes on freely in their interior.

FIG. 2 illustrates the incorporation of the emitting element (the "cathode" proper) in a cathode structure as used in a linear-beam microwave tube. Cathode 10' is machined to have a smooth concave emitting surface 20' (usually spherical). Its base is fitted onto a cylindrical support 22, as of molybdenum or tantalum and attached thereto as by welding at junction 23. A radiant heater 24, as of tungsten wire in a bifilar spiral is supported by its legs 25 by the support means (not shown) of cylinder 22.

It will be obvious to those skilled in the art that many variations of the above-described cathode and process of production can be made within the true scope of the invention. The proportions of the various components can cover a wide range. For example, I believe the ratio of iridium to tungsten may vary from about 20% to about 80%. The "barium" may also include calcium, and/or strontium, or mixtures thereof. The "tungsten" may be molybdenum, tungsten, or their alloys. The "iridium" may be osmium, ruthenium, rhenium, iridium or alloys thereof.

The particular embodiments described above are illustrative and not intended to be limiting. The invention is to be limited only by the following claims and their legal equivalents.

I claim:

1. A thermionic cathode comprising:

a porous matrix of an alloy of at least one noble metal of the platinum group with a refractory metal of the group consisting of tungsten, molybdenum and alloys of these, porous agglomerates dispersed in said matrix having dimensions large compared to the components of said matrix, said agglomerates being composed of one of said refractory metals, and the pores of said matrix and said agglomerates being filled with an active material comprising at least one alkaline earth oxide.

2. The cathode of claim 1 wherein said active material further comprises aluminum oxide.

3. The cathode of claim 1 wherein said platinum group metal is iridium.

4. The cathode of claim 1 wherein said refractory metal is tungsten.

5. The cathode of claim 1 further comprising a smooth surface adapted for electron emission.

6. The cathode of claim 5 further comprising a uniform, homogeneous layer on said smooth surface, said layer comprising said noble metal and said refractory metal.

7. The cathode of claim 6 wherein the composition of said layer is approximately the average composition of said matrix.

8. The cathode of claim 1 further comprising means for supporting said cathode.

9. The cathode of claim 1 further comprising means for heating said cathode to a temperature of about 1000° C. to 1100° C.

10. A process for manufacturing a thermionic cathode comprising the steps of:

forming a porous body by sintering together particles of a refractory metal of the group consisting of tungsten, molybdenum and alloys of these, mechanically breaking down said porous body into fines and agglomerates, said agglomerates being large compared to said particles, mixing said agglomerates with particles, of dimensions small compared to said agglomerates, said particles containing at least one noble metal of the group consisting of iridium, rhenium, ruthenium and osmium, compressing said mixture, sintering said mixture to adhere said particles and said agglomerates into a porous mass, impregnating said mass with a molten oxide comprising an alkaline earth oxide.

11. The process of claim 10 further comprising the steps, after sintering said mixture, of:

impregnating said porous mass with a liquid, converting said liquid to a solid to support said porous mass, machining said mass to the shape of a desired cathode, removing said solid.

12. The process of claim 11 further comprising the steps of:

machining on said cathode shape a smooth surface adapted for electron emission, depositing on said smooth surface a uniform, homogeneous layer comprising said noble metal and said refractory metal.

13. The process of claim 12 wherein the composition of said layer is approximately the average composition of said particles containing said noble metal.

14. The process of claim 11 further comprising the step of affixing said cathode to support means.

15. The process of claim 14 further comprising the step of attaching to said support means a heater near said cathode capable of heating said cathode to about 1000 to 1100 degrees Celsius.

* * * * *